US005595070A

United States Patent [19]

Gray, Sr. et al.

[11] Patent Number: 5,595,070

[45] **Date of Patent: *Jan. 21, 1997**

[54] PRODUCT FABRICATING ATTACHMENT AND METHODS OF CONSTRUCTING

[76] Inventors: Gerald M. Gray, Sr., 968 S. Union St., Concord, N.C. 28025; Randy L. Gray, Box 429, Rte. 1, Denton, N.C. 27239

[ * ] Notice: The terminal 54 months of this patent has been disclaimed.

[21] Appl. No.: 489,260

[22] Filed: Mar. 5, 1990

[51] Int. Cl.[6] ..... D04B 35/00

[52] U.S. Cl. ..... 66/147; 66/149 S

[58] Field of Search ..... 66/147, 149 S

[56] References Cited

U.S. PATENT DOCUMENTS

| | | | |
|---|---|---|---|
| 3,017,314 | 1/1962 | Kebekus et al. | 66/147 X |
| 3,550,402 | 12/1970 | Colton | 66/147 |
| 4,028,910 | 6/1977 | Gnall et al. . | |
| 4,069,090 | 1/1978 | Boyer | 66/147 X |
| 4,102,727 | 7/1978 | Bell . | |
| 4,157,651 | 6/1979 | Coggins et al. | 66/147 |
| 4,319,952 | 3/1982 | Schjeldahl . | |

*Primary Examiner*—John J. Calvert
*Attorney, Agent, or Firm*—Shefte, Pinckney & Sawyer

[57] ABSTRACT

An attachment for the cylinder apparatus of a circular knitting machine which produces lock stitched hosiery. The attachment further includes an additional attachment which provides a mechanism to gather and sever a tubular hosiery segment intermediate its distal ends, creating two equal sized hosiery segments each having a closed end and an open end for use as foot covers, or footies, and having the advantage of creating two footies per cut with virtually no waste. A collar connecting device interconnects an extension cylinder to a standard cylinder tube on an existing knitting machine. The collar connecting device permits a double cylinder arrangement with an intermediate gathering, sealing and cutting device which yields a pair of hosiery footies with a single cutting action thus doubling the standard output, and eliminating the usual waste product.

9 Claims, 7 Drawing Sheets

PRODUCT FABRICATING ATTACHMENT AND METHODS OF CONSTRUCTING

The invention relates to an attachment for an apparatus for forming an end closure in a tubular fusible article, a product produced thereby, and methods of constructing and utilizing same.

RELEVANT ART

The relevant art is exemplified by the following U.S. Pat. Nos.: Colton 3,550,402; Wignall et al. 4,028,910; Boyer 4,069,090; Bell 4,102,727; Coggins et al. 4,157,651; and Schjeldahl 4,319,952.

A standard knitting machine in the industry for producing a stretchable, lock stitch hosiery tube is known in the art. As the hosiery fabric is knitted, the machine (such as that disclosed in Boyer U.S. Pat. No. 4,069,090) provides a standard cylinder around which the tubular hosiery fabric is caused to travel. The hosiery fabric is knitted in a circular cross-section which grows longitudinally, creating a tubular hosiery shape as the fabric is knitted. As the tubular hosiery segment is knitted, it is permitted to pass over a cylinder element.

When the tubular hosiery segment reaches a predetermined length, the cylinder element gathers the tubular hosiery segment to a central point, at which time the tubular hosiery segment is heat treated at the gathered central point. The heat treatment serves the dual purpose of cutting the tubular hosiery segment to a predetermined length and also melts the hosiery fabric at a central gathering point, thus closing and sealing the tubular hosiery segment at the central gathering point. The result is a single hosiery tubular segment having one circular open end and one sealed closed end, making a finished product which may be utilized as a foot cover or footie.

The severed tubular hosiery segment leaves two sealed ends, one on each side of the cut. The sealed end removed from the footie is discarded as a waste product which is vacuumed away from the cylinder.

Inherent in the prior art design is the creation of double-sealed tubular elements, one of which is useful as a footie, the other of which is waste. The footies are popular as disposable stockings often used in the retail shoe trade.

SUMMARY OF THE INVENTION

The present invention provides an attachment for an apparatus for forming an end closure in a substantially tubular fusible article, comprising, in combination, a knitting machine for producing the substantially tubular fusible article, and first substantially tubular means for releasably receiving the substantially tubular fusible article from the knitting machine. A collar assembly releasably retains the tubular means proximate a first end portion of the tubular means. First mounting means releasably connects the collar assembly to the knitting machine in a predetermined position relative to the knitting machine. Means are provided for fusing and cutting the tubular fusible article. Second mounting means releasably connects the tubular means to the fusing and cutting means in a predetermined position relative to the fusing and cutting means. The tubular means has an interior length sufficient in conjunction with the knitting machine to accommodate a finished product, whereby during each cycle the fusing and cutting means produces two separated finished products, each having a fused end closure therein.

The invention also provides a finished product as produced by the above described attachment.

The invention was designed and engineered as a modification of the Boyer apparatus to overcome disadvantages of the state of the art. The invention utilizes a unique connector element to replace the cylinder element of the current state of the art with a novel replacement tubular means or cylinder which results in the utilization of the same gathering, cutting and sealing action to make two footies during cycle, and with the elimination of all waste at the same time.

The basic design includes a cylinder element which utilizes the same knitting machine presently in use for knitting tubular hosiery, and modifies the sealing and cutting cylinder in a unique design which permits a cut intermediate the distal ends of a tubular length of knitted hosiery material, rather than adjacent to a distal end.

An object of the invention is to provide an attachment to a tubular knitting machine which will double present output and totally eliminate process waste.

A further object is to provide an attachment to a tubular knitting machine which can be added to a conventional machine in a fast, economical manner.

Other objects and advantages of the present invention will become apparent to those skilled in the art after considering the following specification which discloses a preferred embodiment thereof in conjunction with the accompanying drawings.

DETAILED DESCRIPTION

Figure 1:
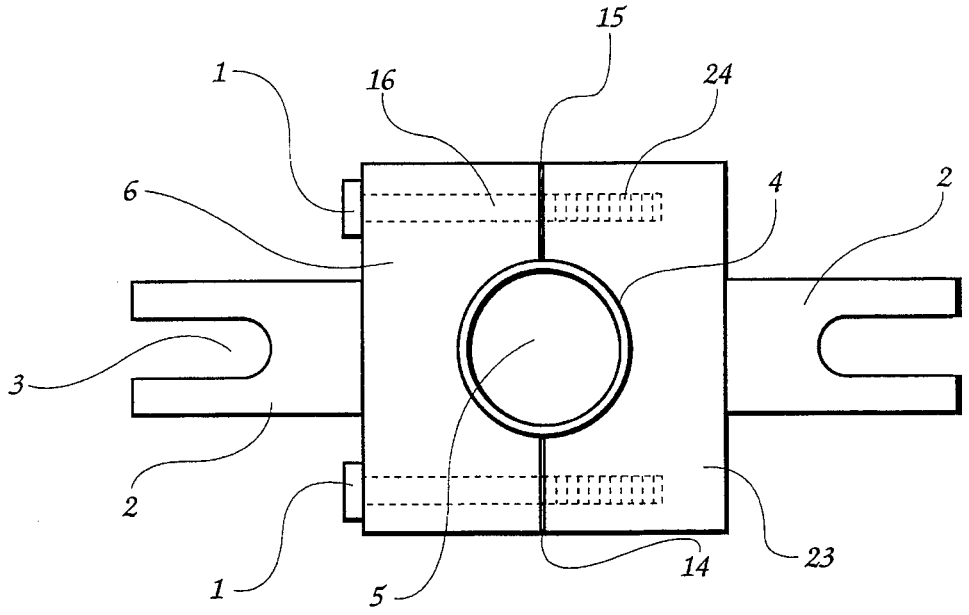
FIG. 1 is a top elevational plan view of the mounting collar of a preferred embodiment of the invention.

Referring to the drawings, wherein like reference numerals indicate the like parts, various views of a preferred embodiment are shown.

Figure 4:
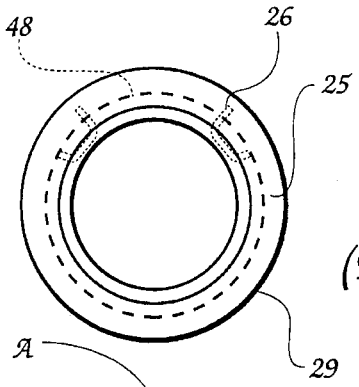
Fig. 4 (PRIOR ART)
FIG. 4 is a top elevational plan view of the standard cylinder tube known in the knitting machine art.
Figure 5:
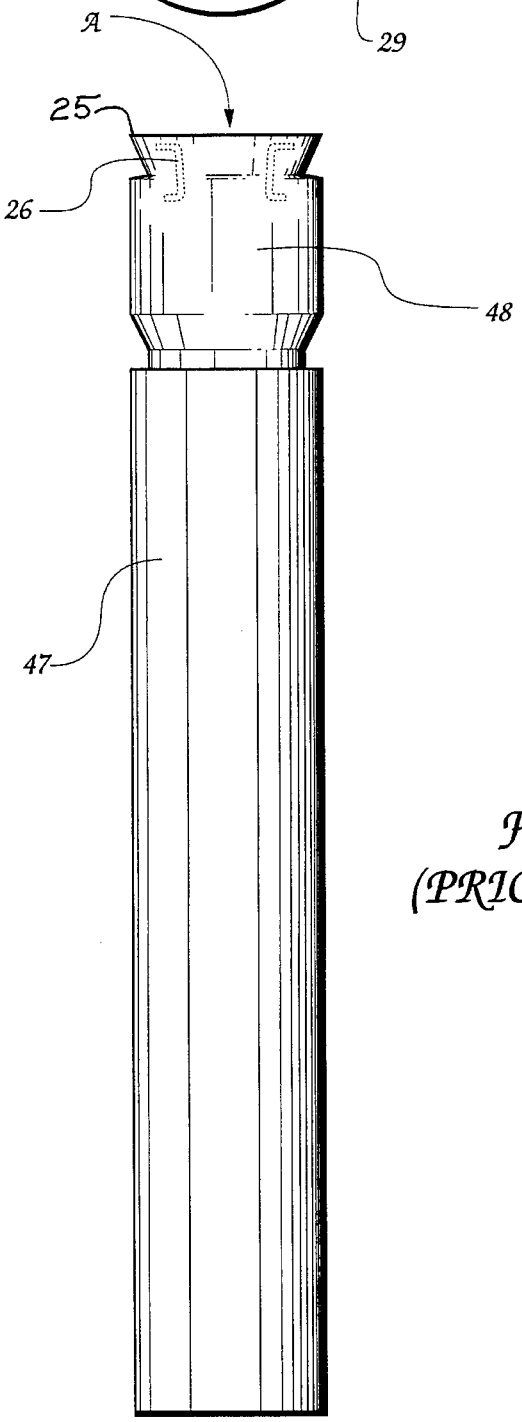
Fig. 5 (PRIOR ART)
FIG. 5 is a front elevational view standard cylinder tube known in the knitting machine art.
Figure 9:
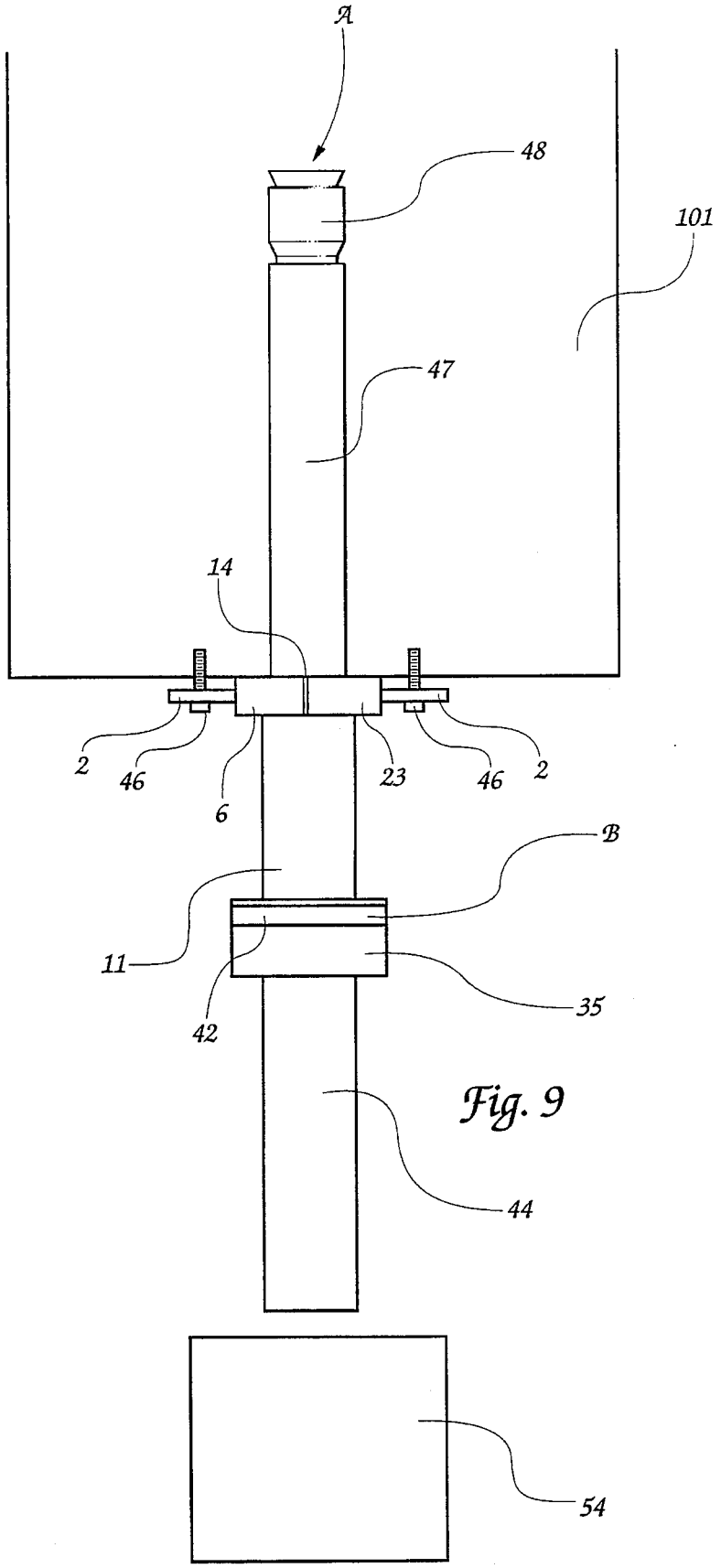
FIG. 9 is a schematic representation of the unique attachment of the invention as attached to the standard burning element known in the knitting machine art.
Figure 10:
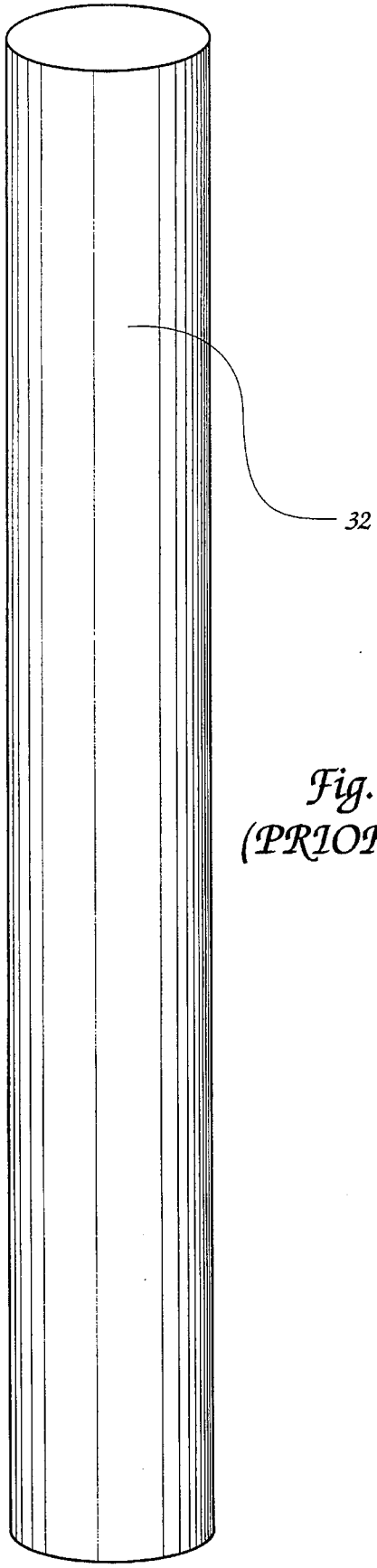
Fig. 10 (PRIOR ART)
FIG. 10 is a schematic illustration of the tubular hosiery material made by a conventional knitting machine known in the art.

Referring first to FIGS. 4, 5 and 9, a standard knitting machine, generally referred to as 101 (shown in FIG. 9), is provided with an inside cylinder tube 47, which serves as an interior liner through which knitted hosiery fabric is pulled in direction A as said fabric is knitted in an elongating hosiery tube 32 (as shown in FIG. 10). Cylinder tube 47 is typically provided with a transition element 48 which acts as a mouth to receive fabric 32 for introduction to the interior of cylinder tube 47.

With reference to FIGS. 4 and 5, the transition element 48 includes multiple fabric guards 26 located around the interior surface of transition element 48 to direct fabric 32 through the tube 47. The upper portion of transition element 48 includes a top rim 25 and an interior neck 29 through which the knitted fabric tube 32 is directed.

Figure 2:
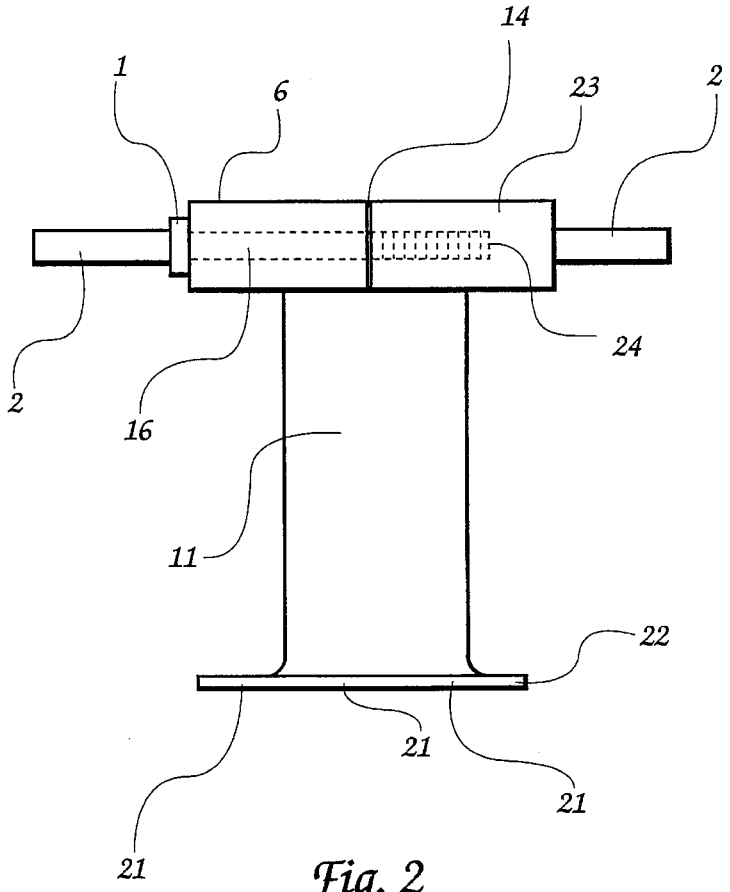
FIG. 2 is a side elevational view of the mounting collar and connecting tube of the preferred embodiment.
Figure 3:
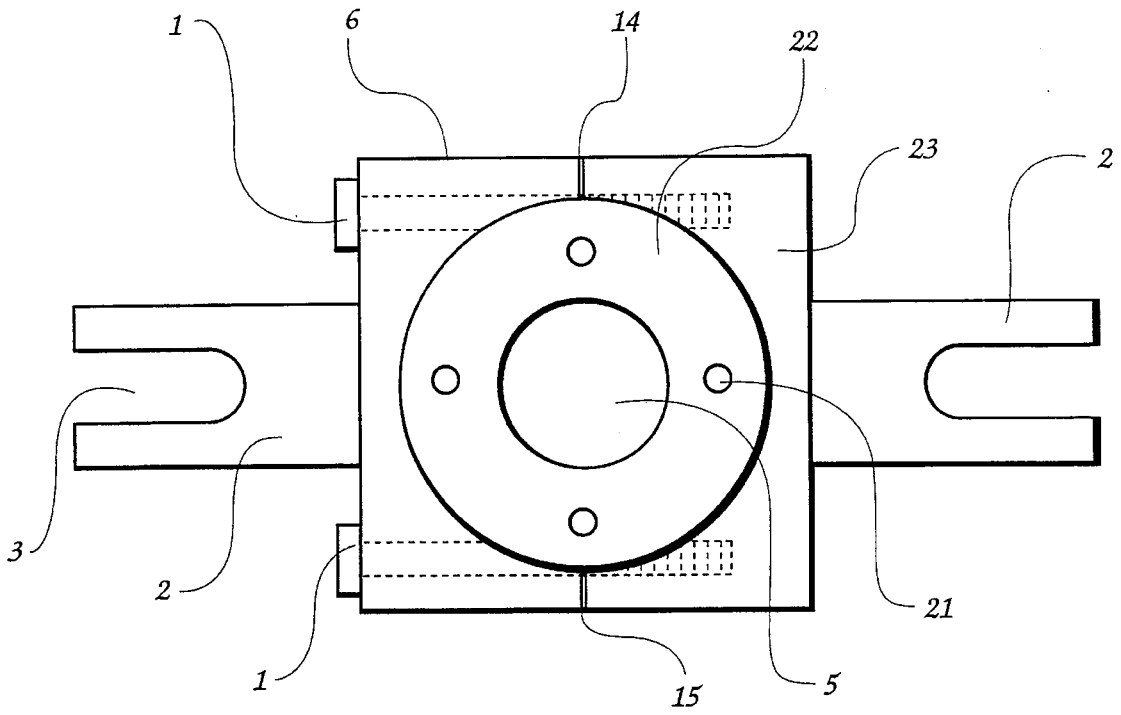
FIG. 3 is a bottom elevational view of the mounting collar of the preferred embodiment.

In order to double the output of conventional knitting machines, an attachment is provided comprised of several elements including a collar assembly shown in FIGS. 1, 2 and 3. The collar assembly is comprised of collar halves 6 and 23 which fit together along common lines 14 and 15 and which form a mating interface. Collar halves 6 and 23 mate to form a relatively thin, substantially rectangular collar having central hole 5 which is preferably chamfered around an upper rim 4. Central hole 5 is dimensioned to receive a connecting tube 11, which is frictionally received within hole 5. The upper rim of tube 11 is positioned flush with rim 4, so that the length of tube 11 extends downwardly from collar halves 6 and 23.

Collar halves 6 and 23 are releasably held together by a clamp or expedient such as screws 1 which may be inserted into holes 16 and screwed into threaded taps 24 to releaseably hold tube 11. In addition, a pair of mounting brackets 2 are integrally attached to the full length sides of collar halves 6 and 23. Mounting brackets 2 are each provided with elongated slots 3 which permit the centering of the collar assembly to inside cylinder tube 47 of the knitting machine 101, as shown in FIG. 9.

In the knitting machine 101, as shown in FIG. 9, a thermoplastic yarn is lock stitched to form a hosiery fabric which is knitted in a circular pattern which forms a tubular hosiery fabric as the circular pattern is increased. In order to maintain the hosiery fabric in a tubular shape, it is directed through the interior of inside cylinder tube 47, and is pulled through the tube 47, and forced to the interior surface of tube 47 by a vacuum. As the tubular fabric is directed by tube 47, from its entry port at 25 in FIGS. 4 and 5, through the full length of inside cylinder tube 47, it passes through a burning and cutting heater element, generally shown as B (FIG. 9).

Figure 6:
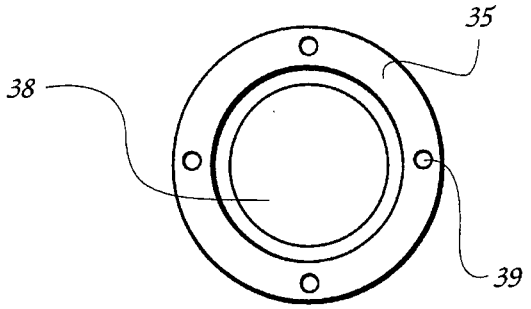
Fig. 6 (PRIOR ART)
FIG. 6 is a plan view of the top ring of the sealing and cutting element of a standard hosiery knitting machine shown in the open position.
Figure 7:
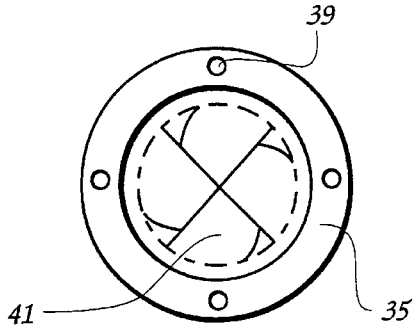
Fig. 7 (PRIOR ART)
FIG. 7 is a plan view of the top ring of the sealing and cutting element of a standard hosiery knitting machine shown in the closed position.
Figure 8:
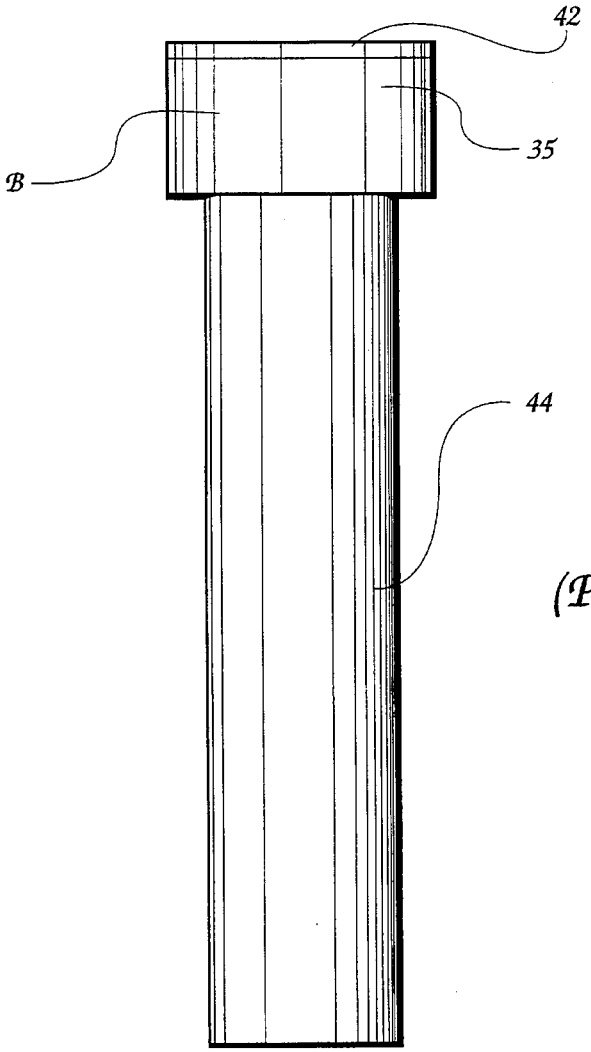
Fig. 8 (PRIOR ART)
FIG. 8 is a front elevational view of the standard burning take device known in the knitting machine art.

The burning and cutting heater element B is comprised of a mounting housing 35 having mounting holes 39, as shown in FIGS. 6, 7 and 8. The upper surface of housing 35 is comprised of ring 42, which contacts the discharge port of the tube 47, and is mounted to the knitting machine by mounting screws passing through holes 39 into the body of knitting machine 101. The interior of housing 35 includes a tubular port 38 which connects to the interior of an extension tube 44. Extension tube 44 is of sufficient length to receive a predetermined length of tubular housing fabric 32 as shown in FIG. 10.

In actual operation, the tubular housing fabric 32 is pushed through tube 47, housing 35, and extension tube 44.

Housing 35 is provided with a heatable gathering means, such as jaws 41, which rotate from an open position as shown in FIG. 6, to a closed position as shown in FIG. 7 gathering the hosiery tube 31 at 41. As the gathering jaws 41 rotate to a closed position, they are heat energized which serves to melt the thermoplastic yarn into a heat sealed knot and actually burns the hosiery tube in two. The result is a finished product consisting of a tubular stocking in extension tube 44, which is then discharged into collection box 54. A small waste hosiery tube located above the gathering means 41 is cut, removed as waste, and the length of hosiery tubing 32 remaining in tube 47, is now permitted to proceed through housing 35 and extension 44, so that the process may be repeated.

In the instant invention, the housing 35 is disconnected along with extension tube 44, and is replaced with the collar assembly being mounted as was housing 35 to the knitting machine 101, using slots 3 to center the assembly and being secured by screws 46.

Connecting tube 11 is made of such length so that its interior together with the interior of the tube 47 represents the length of a finished hosiery product. The length of extension tube 44 likewise is of sufficient length to accommodate a finished hosiery product of a length corresponding to the length of tube 44. Integrally affixed to the lower end of tube 11 is a mounting ring 22 having mounting holes 21, which correspond to the mounting holes in conventional housing 35, so that housing 35 may be subsequently releasably attached to the base ring place 22 of the collar assembly, creating the resulting assembly shown in FIG. 9.

Figure 12:
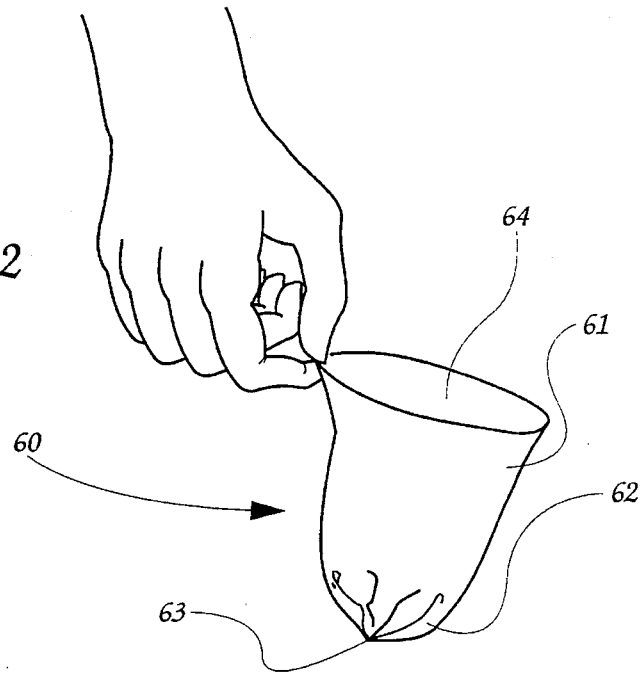
FIG. 12 shows the novel footie.
Figure 13:
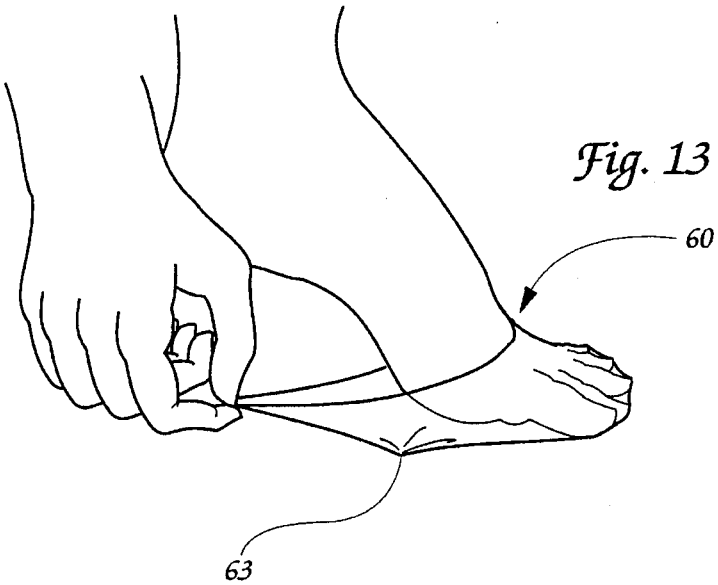
FIG. 13 shows the FIG. 12 being placed on the foot.
Figure 14:
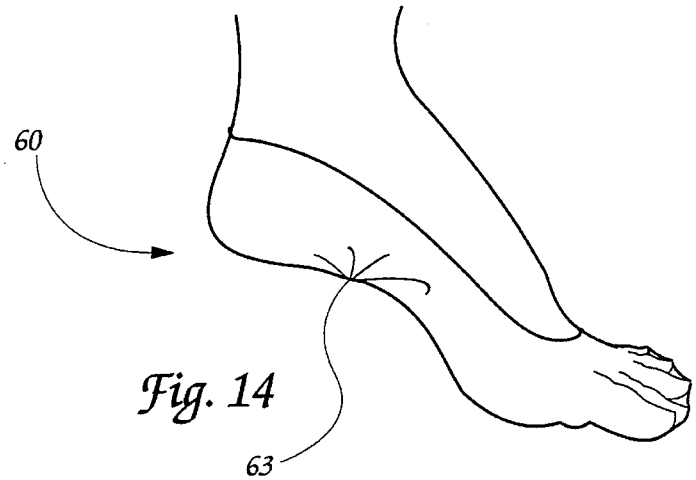
FIG. 14 shows the footie completely in place on the foot.

With reference to FIGS. 12, 13 and 14, the novel footie 60 is shown. Footie 60 has a main portion 61 and a front portion 62. Portion 62 has the fused end closure 63 therein. Portion 61 has a foot entrance opening 64 therein.

OPERATION

Figure 11:
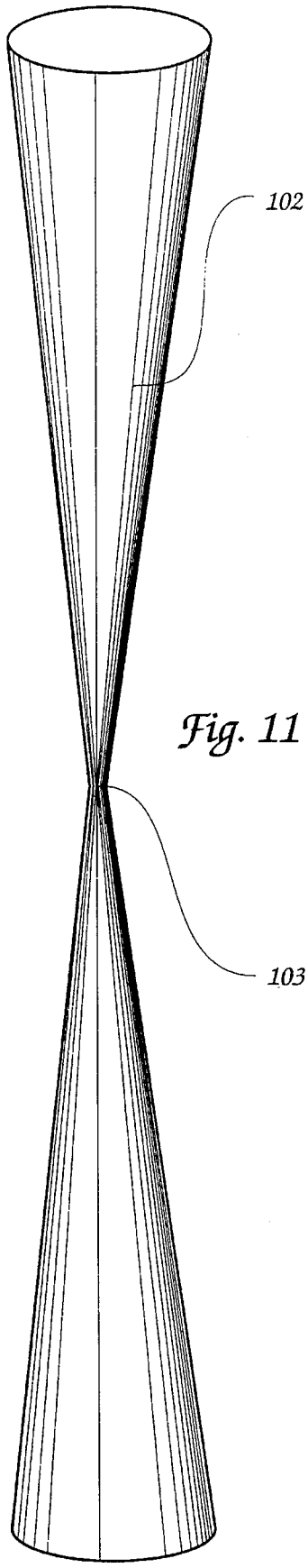
FIG. 11 is a schematic illustration of the tubular hosiery material of the invention as it is gathered for burning by the attachment to the standard knitting machine.

As may be seen in the foregoing disclosure, the knitted hosiery fabric 32 is pulled through the discharge port of tube 47, continues through collar and connecting hole 11, through housing 35, and into extension tube 44. Gather jaws 41 close, as previously described, to seal and secure hosiery tube 32. Hosiery tube 32 assumes the shape shown in FIG. 11 at 102 just before being severed at point 103. Thereafter, the hosiery cone 102 is severed at the discharge port of cylinder hole 47. The two stocking finished products are removed, and the process may be repeated without any discharge waste and in the same cycle producing two, rather than one finished product.

We claim:

1. An attachment for an apparatus performing an end closure in a substantially tubular fusible article, comprising, in combination:

a knitting machine for producing said substantially tubular fusible article;

first substantially tubular means for releasably receiving said substantially tubular fusible article from said knitting machine;

a collar assembly for releasably retaining said first substantially tubular means proximate a first end portion of said first substantially tubular means;

first mounting means for releasably connecting said collar assembly to said knitting machine in a predetermined position relative to said knitting machine;

means for fusing and cutting said substantially tubular fusible article;

second mounting means for releasably connecting said first substantially tubular means to said fusing and cutting means in a predetermined position relative to said fusing and cutting means;

said knitting machine and said first substantially tubular means collectively having an interior length which is sufficient to accommodate a finished product;

whereby two separated finished products each having a fused end closure therein are produced.

2. An attachment according to claim 1, wherein:

said collar assembly is substantially rectangular in shape;

said collar assembly comprises a pair of collar half portions which fit together along common lines to form a mating interface;

said collar half portions mate together to form a central hole therein which is dimensioned to receive said tubular means therein.

3. An attachment according to claim 2, wherein:

said central hole in said collar assembly is chamfered around an upper rim thereof;

said first substantially tubular means comprises a connecting tube having an upper rim which is positioned flush with the upper rim of said central hole of said collar assembly.

4. An attachment according to claim 3, wherein:

said collar half portions are releasably held together by fastening means to releasably hold said connecting tube.

5. An attachment according to claim 4, wherein:

said first mounting means comprises a pair of mounting brackets, each of which is integrally attached to an associated one of said collar half portions; and each said mounting bracket is provided with an elongated slot to permit centering and positioning of said collar assembly relative to an inside cylinder tube of said knitting machine.

6. An attachment according to claim 5, wherein:

said fusing and cutting means comprises a burning and cutting heater element disposed in a mounting housing; and said second mounting means comprises a mounting ring having mounting holes therein which correspond to mounting holes in said mounting housing of said fusing and cutting means.

7. An attachment according to claim 6, wherein:

said fusing and cutting means is selectively heat energized, melts said tubular fusible article into a heat-sealed knot, and burns the tubular fusible article in two to produce said two separated fusible products each having a fused end closure therein.

8. An attachment according to claim 7, wherein:

an extension tube depends from said mounting housing, and said extension tube is of sufficient length to accommodate said finished product; and said fusing and cutting means serves to burn the fusible article in two, leaving one of said finished products within said first substantial tubular means, and the other of said finished products in said extension tube.

9. A method of fabricating hosiery footies, comprising the steps of:

knitting a hosiery fabric;

pulling said hosiery fabric through a discharge port of a knitting machine, and then through a collar assembly, first substantially tubular means, fusing and cutting means, and into an extension tube;

gathering the hosiery fabric near a central point thereof, and applying heat thereto;

severing the hosiery fabric at said central point to form two hosiery footies each having an open end therein and a fused end closure therein.

* * * * *